US011084286B2

(12) United States Patent
Ninagawa

(10) Patent No.: US 11,084,286 B2
(45) Date of Patent: Aug. 10, 2021

(54) LIQUID EJECTION HEAD AND METHOD FOR MANUFACTURING THE SAME

(71) Applicant: CANON KABUSHIKI KAISHA, Tokyo (JP)

(72) Inventor: Takeshi Ninagawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 16/717,089

(22) Filed: Dec. 17, 2019

(65) Prior Publication Data

US 2020/0189276 A1 Jun. 18, 2020

(30) Foreign Application Priority Data

Dec. 18, 2018 (JP) ..... JP2018-236284

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1623* (2013.01); *B41J 2002/14491* (2013.01)

(58) Field of Classification Search
CPC ..... B41J 2/1433; B41J 2/162; B41J 2/1623; B41J 2002/14491
See application file for complete search history.

(56) References Cited

U.S. PATENT DOCUMENTS 8,740,353 B2 6/2014 Kimura et al.
9,463,624 B2 * 10/2016 Seki ..... B41J 2/1753

FOREIGN PATENT DOCUMENTS

JP 2012-101425 A 5/2012

* cited by examiner

*Primary Examiner* — Thinh H Nguyen
(74) *Attorney, Agent, or Firm* — Venable LLP

(57) ABSTRACT

Reliability of an electric wiring substrate against a change in temperature in a liquid ejection head can be achieved. The liquid ejection head has an element substrate and an electric wiring substrate. Upon manufacturing the liquid ejection head, a second portion of the electric wiring substrate overlaps a second support surface through an adhesive so that the electric wiring substrate straddles a groove between a first support surface to which a first portion, which is one end of an electric wiring substrate, is bonded and a second support surface, and a second portion and a third portion are pressed by a pressing tool so that the third portion of the electric wiring substrate, which is a portion between the first portion and the second portion, is pushed into the groove, and the second portion is bonded to the second support surface.

17 Claims, 8 Drawing Sheets

LIQUID EJECTION HEAD AND METHOD FOR MANUFACTURING THE SAME

BACKGROUND OF THE INVENTION

Field of the Invention

The present invention relates to a liquid ejection head for ejecting liquid from an ejection orifice and a method for manufacturing the same.

Description of the Related Art

A liquid ejection head generally has a recording element substrate that includes an ejection orifice configured to eject liquid and an energy-generating element configured to generate energy for ejecting the liquid from an ejection orifice. In order to supply an electric signal for driving the energy-generating element to the recording element substrate, the recording element substrate is bonded to another substrate or a member by an electric wiring substrate.

Japanese Patent Application Laid-Open No. 2012-101425 discloses a liquid ejection head in which one end of a flexible wiring substrate (electric wiring substrate) is connected to a recording element substrate and the other end is connected to an electrical contact substrate.

SUMMARY OF THE INVENTION

A method for manufacturing a liquid ejection head including an element substrate that includes an ejection orifice configured to eject liquid and an energy-generating element configured to generate energy for ejecting the liquid from the ejection orifice, and an electric wiring substrate that supplies an electric signal for driving the energy-generating element to the element substrate, includes overlapping a second portion of the electric wiring substrate and a second support surface through an adhesive so that the electric wiring substrate straddles a groove between a first support surface to which a first portion, which is one end of the electric wiring substrate, is bonded and the second support surface; and pressing the second portion and a third portion by a pressing tool to bond the second portion and the second support surface so that the third portion of the electric wiring substrate, which is a portion between the first portion and the second portion is pushed into the groove.

Further features of the present invention will become apparent from the following description of exemplary embodiments with reference to the attached drawings

DESCRIPTION OF THE EMBODIMENTS

Figure 1A:
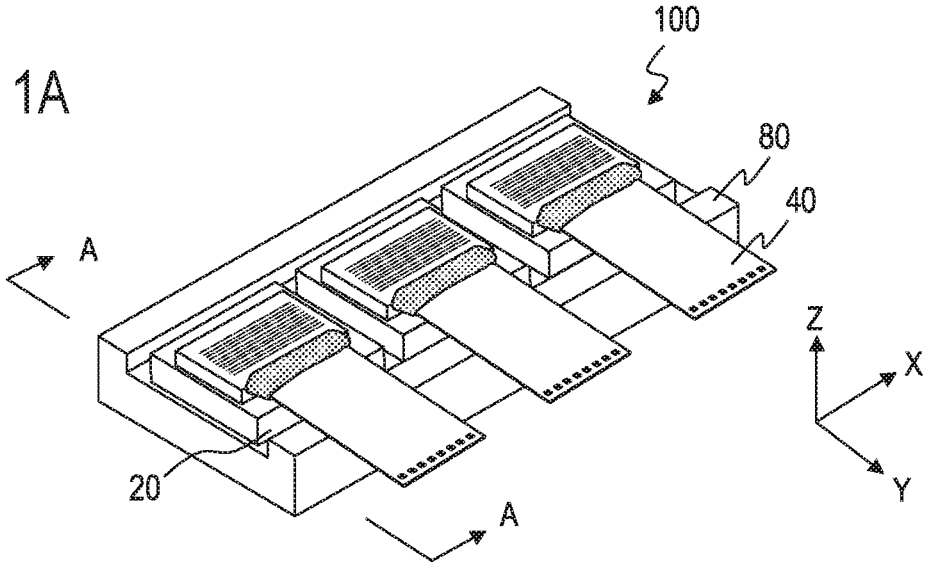
FIG. 1A, FIG. 1B and FIG. 1C are schematic configuration diagrams of an example of a liquid ejection head to which the present invention is applied.

In order to secure alignment accuracy when bonding an electric wiring member to another substrate or a member, one end of the electric wiring member may be connected to a support member, and then an intermediate portion of the electric wiring member may be bonded to the other support member. However, since the other support member and an electric wiring substrate usually have different linear expansion coefficients, if the electric wiring substrate is bonded to the other support member in a state in which the electric wiring substrate is tensioned, wirings of the electric wiring substrate are likely to be broken due to a change in temperature.

An object of the present invention is to provide a method for manufacturing a liquid ejection head capable of increasing reliability of an electric wiring substrate against a change in temperature.

According to the present invention, it is possible to increase the reliability of the electric wiring substrate against the change in temperature.

Hereinafter, embodiments of the present invention will be described with reference to the drawings. Although the present embodiment is directed to an inkjet recording head that ejects ink, the present invention can be widely applied to a liquid ejection head that ejects liquid other than the ink. The number or positions of ejection orifices and the number or pitches of recording element substrates illustrated in the drawing are merely one example, and the present invention is not limited to the liquid ejection head illustrated in the drawings. First, a configuration of an exemplary liquid ejection head 100 to which this embodiment is applied will be described.

In the drawings and the following description, an X direction means a longitudinal direction of the liquid ejection head 100 or a second support member 80, a Y direction means a lateral direction of the liquid ejection head 100 or the second support member 80, and the Y direction is orthogonal to the X direction. The Y direction corresponds to a width direction of a groove 20 formed between a first support member 30 and the second support member 80. A Z direction is orthogonal to the X direction and the Y direction, and corresponds to an ink ejection direction of the liquid ejection head 100.

Configuration of Liquid Ejection Head 100

Figure 1B:
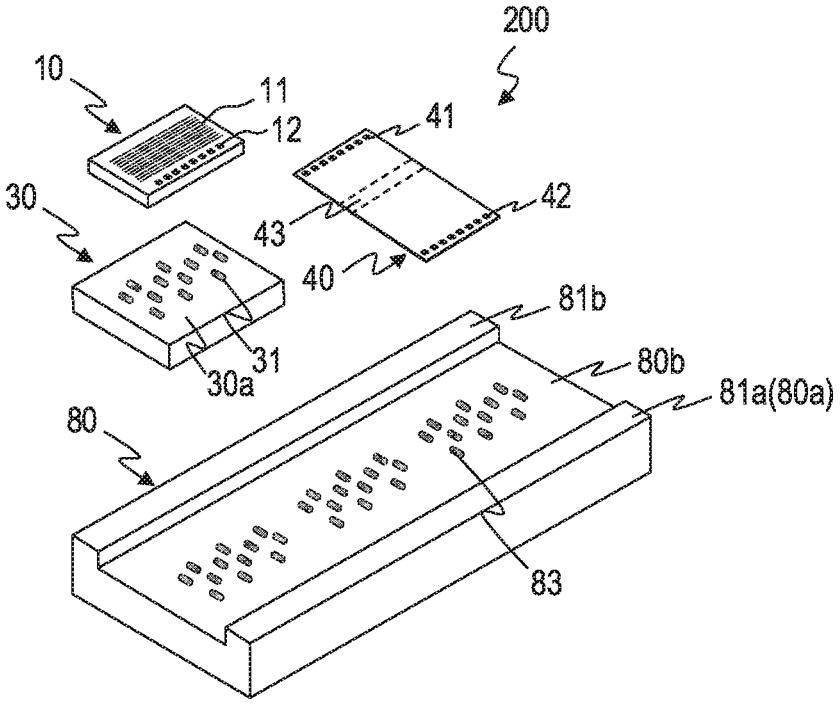
Figure 1C:
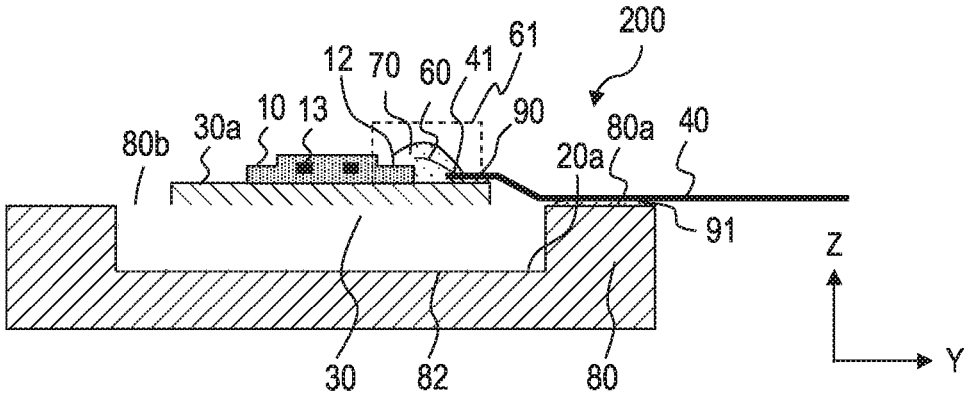

FIG. 1A is a perspective view of the liquid ejection head 100 to which the present embodiment is applied, FIG. 1B is an exploded perspective view thereof, and FIG. 1C is a cross-sectional view taken along the line A-A in FIG. 1A. The liquid ejection head 100 has a recording element substrate 10, the first support member 30, the second support member 80, and an electric wiring substrate 40. The recording element substrate 10 includes an ejection orifice 11 that ejects ink, an energy-generating element 13 that generates energy for ejecting ink from the ejection orifice 11, and an electrode 12 to which the electric wiring substrate 40 is connected.

The first support member 30 includes a first support surface 30*a* that supports the recording element substrate 10. One end of the electric wiring substrate 40 is bonded to the first support surface 30*a* by a first adhesive 90. The first support member 30 includes a flow path (not illustrated) for supplying ink to the recording element substrate 10, in which openings 31 through which the ink flows are provided on the first support surface 30*a*. In order to support the recording element substrate 10, the first support member 30 is preferably formed of a material having high flatness and sufficiently high reliability, for example, ceramics such as alumina.

The second support member 80 has a substantially rectangular parallelepiped shape. The second support member 80 has a third support surface 80*b* that supports the first support member 30 at a center in the Y direction, and protrusions 81*a* and 81*b* protruding in a Z direction from the third support surface 80*b* on both sides of the third support surface 80*b* in the Y direction. A top surface of one protrusion 81*a* is a second support surface 80*a* to which an intermediate portion 43 between both end portions of the electric wiring substrate 40 is bonded. The third support surface 80*b* has openings 83 through which ink is supplied to the first support member 30. The groove 20 is provided between the first support surface 30*a* and the second support surface 80*a* in the Y direction, and a bottom surface 20*a* of the groove 20 constitutes a part of the third support surface 80*b*. The first support surface 30*a* is further away from the bottom surface 20*a* of the groove 20 in the Z direction than the second support surface 80*a*. The second support member 80 is also referred to as a "support member", and the first support member 30 is also referred to as a "support member different from the support member".

The electric wiring substrate 40 supplies an electric signal for driving the energy-generating element 13 to the recording element substrate 10. The electric wiring substrate 40 extends in the Y direction between the first support surface 30*a* and the second support surface 80*a* so as to straddle the groove 20. In FIG. 1C, a space between the electric wiring substrate 40 and the bottom surface 20*a* of the groove 20 is a space which is not filled with a sealant or the like, but after the electric wiring substrate 40 is bonded to the first support surface 30*a* and the second support surface 80*a*, this space may be filled with the sealant or the like. The electric wiring substrate 40 is a flexible wiring substrate in which two thin and soft insulating polyimide films sandwich an electroconductive copper foil printed wiring and stick on each other. A thickness of the electric wiring substrate 40 is about 0.3 mm. Since one polyimide film is smaller than the other polyimide film, both end portions of the copper foil printed wiring are exposed. The exposed portions at both ends form a first connection terminal 41 and a second connection terminal 42. The first connection terminal 41 is electrically connected to the electrode 12 of the recording element substrate 10 by wire bonding. The second connection terminal 42 is used as a connection terminal with the outside, and is electrically connected to a device (not illustrated) that generates an electric signal. The electrode 12 of the recording element substrate 10, a wire 60, and the first connection terminal 41 of the electric wiring substrate 40 are collectively referred to as an electrical connection part 61. The electrical connection part 61 is covered with a sealing material 70.

Method for Manufacturing Liquid Ejection Head 100

Figure 2:
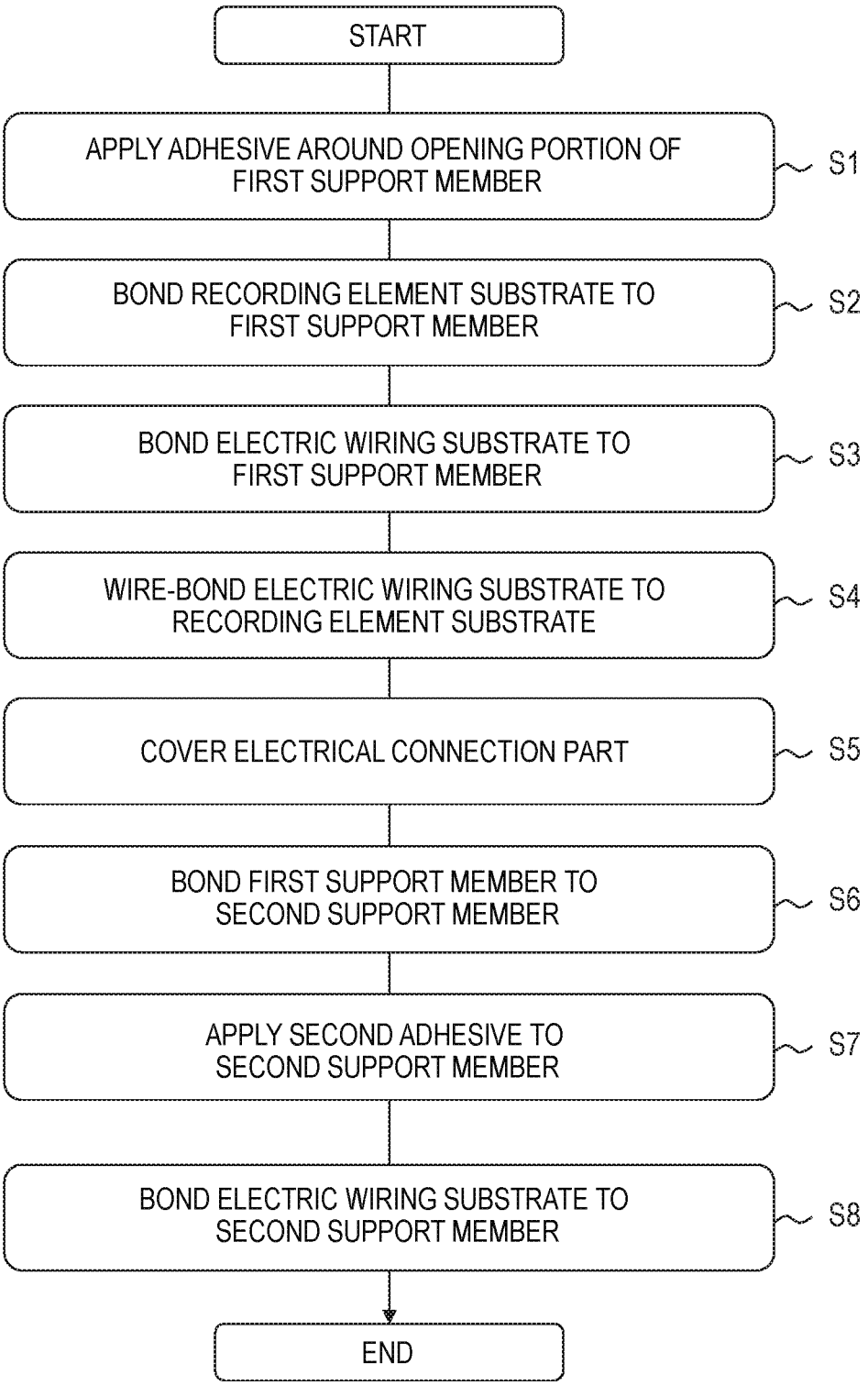
FIG. 2 is a schematic flowchart illustrating a method for manufacturing a liquid ejection head illustrated in FIG. 1A, FIG. 1B and FIG. 1C.

Next, a method for manufacturing the liquid ejection head 100 described above will be described based on a schematic flowchart illustrated in FIG. 2 and schematic step diagrams illustrated in FIGS. 3A to 3H and FIGS. 4A to 4H.

Figure 3A:
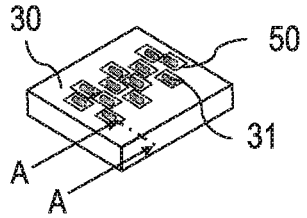
FIG. 3A, FIG. 3B, FIG. 3C, FIG. 3D, FIG. 3E, FIG. 3F, FIG. 3G and FIG. 3H are schematic step diagrams illustrating a method for manufacturing a liquid ejection head illustrated in FIG. 1A, FIG. 1B and FIG. 1C.
Figure 3B:
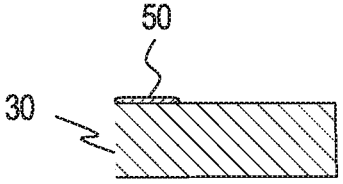

First, in order to bond the recording element substrate 10 and the first support member 30, an adhesive 50 is applied to the first support member 30 (step S1). FIG. 3A is a schematic perspective view of the first support member 30 to which the adhesive 50 is applied, and FIG. 3B is a schematic cross-sectional view taken along the line A-A in FIG. 3A. The adhesive 50 is a thermosetting resin. The adhesive 50 is applied around the opening 31 of the first support member 30. The adhesive 50 is applied by performing drawing with a robot that can move in the X and Y directions. The thickness of the adhesive 50 is, for example, about 0.1 mm, and other methods such as transfer and squeegee can be used as long as the adhesive 50 can be applied with a desired application thickness. The adhesive 50 preferably has sufficient corrosion resistance to ink. The adhesive 50 may be applied to a back surface of the recording element substrate 10, or an adhesive sheet may be used as the adhesive 50.

Figure 3C:
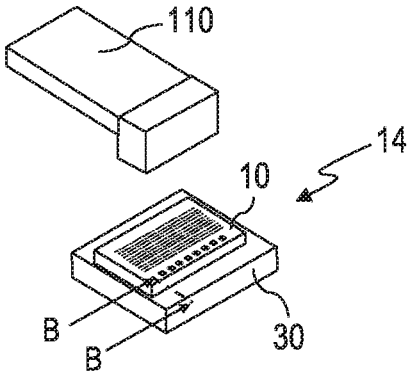
Figure 3D:
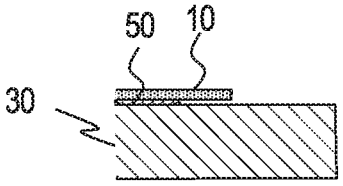

Next, the recording element substrate 10 is bonded to the first support member 30 (step S2). FIG. 3C illustrates a schematic perspective view of the first support member 30 to which the recording element substrate 10 is bonded and an adsorbing tool 110, and FIG. 3D illustrates a schematic cross-sectional view taken along the line B-B in FIG. 3C. In order to improve the recording image quality, the recording element substrate 10 is bonded to the first support member 30 so that a distance from an upper surface of the recording element substrate 10 to a lower surface of the first support member 30 is constant by floating bonding. The floating bonding is a technique in which a thickness of a unit after bonding is made uniform by absorbing a thickness tolerance of parts with an adhesive. Specifically, the recording element substrate 10 is adsorbed by the adsorbing tool 110, the first support member 30 is fixed by a mechanical clamp (not illustrated), and the recording element substrate 10 comes into contact with the adhesive 50. The temperature of the adsorbing tool 110 can rise by electricity. In this embodiment, the temperature of the adsorbing tool 110 rises to 160° C., and the recording element substrate 10 comes into contact with the adhesive 50 for 7 seconds to perform temporary fixing. Instead of raising the temperature of the adsorbing tool 110, the first support member 30 may be heated, and the method for heating the adhesive 50 is not limited to these methods. Thereafter, curing is performed as necessary, and the bonding between the recording element substrate 10 and the first support member 30 is completed. Butting bonding may be used instead of the floating bonding. Note that a unit in which the recording element substrate 10 and the first support member are bonded is also referred to as a recording element unit 14. In this embodiment, the recording element substrate 10 and the first support member 30 are bonded to manufacture the recording element unit 14, but the method for manufacturing the recording element unit 14 is not limited to this method. The recording element substrate 10 having the first support surface 30*a* may be manufactured as the recording element unit 14.

Figure 3E:
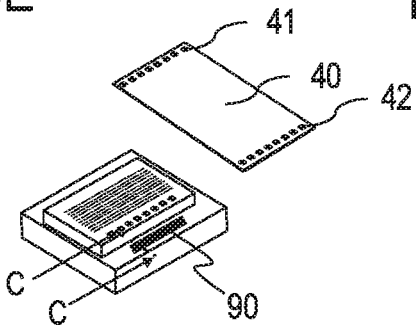
Figure 3F:
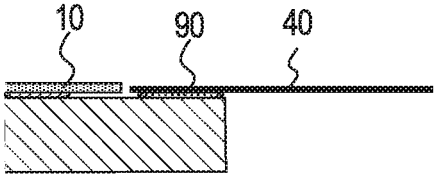

Next, the electric wiring substrate 40 is bonded to the first support member 30 by the first adhesive 90 (step S3). FIG. 3E is a schematic perspective view of the electric wiring substrate 40 and the first support member 30, and FIG. 3F is a schematic cross-sectional view taken along the line C-C in FIG. 3E. The first adhesive 90 is applied to the first support surface 30*a* of the first support member 30, one end of the electric wiring substrate 40 overlaps on the first adhesive 90, and the electric wiring substrate 40 is bonded to the first support member 30. As a result, a bonding portion of the first support member 30 is formed at one end of the electric wiring substrate 40. The first adhesive 90 may be applied to the back surface of the electric wiring substrate 40, and the adhesive sheet may be used as the first adhesive 90.

Figure 3G:
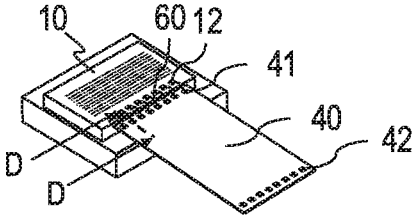
Figure 3H:
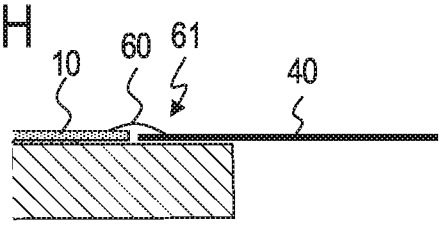

Next, the electric wiring substrate 40 is connected to the recording element substrate 10 by the wire bonding (step S4). FIG. 3G illustrates a schematic perspective view of the electric wiring substrate 40 and the first support member 30 that are connected by the wire bonding, and FIG. 3H illustrates a schematic cross-sectional view taken along the line D-D in FIG. 3G. The first connection terminal 41 of the electric wiring substrate 40 is electrically connected to the electrode 12 of the recording element substrate 10 by the wire 60 to form the electrical connection part 61. Instead of the wire bonding, the electrode 12 and the first connection terminal 41 may be directly compressed.

Figure 4A:
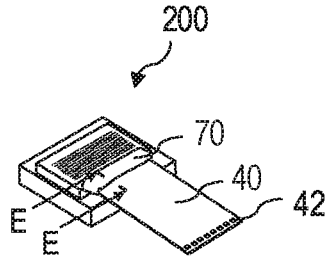
FIG. 4A, FIG. 4B, FIG. 4C, FIG. 4D, FIG. 4E, FIG. 4F, FIG. 4G and FIG. 4H are schematic step diagrams illustrating a method for manufacturing a liquid ejection head illustrated in FIG. 1A, FIG. 1B and FIG. 1C.
Figure 4B:
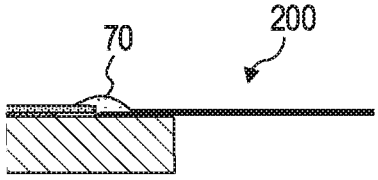

Next, the electrical connection part 61 is sealed with the sealing material 70 (step S5). FIG. 4A is a schematic perspective view of a chip unit 200 in which the electrical connection part 61 is sealed, and FIG. 4B is a schematic cross-sectional view taken along the line E-E in FIG. 4A. The electrical connection part 61 is covered with the sealing material 70 in order to prevent an electrical short due to liquid such as ink. As a result, the chip unit 200 in which the recording element substrate 10 is bonded to the first support member 30, one end of the electric wiring substrate 40 is bonded to the first support member 30, and the electrical connection part 61 is sealed is obtained. The above steps are repeated to bond the plurality of electric wiring substrates 40 and the plurality of first support members 30, respectively, thereby creating a plurality of chip units 200.

Figure 4C:
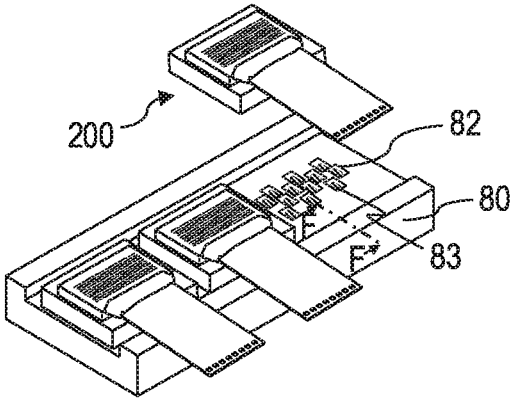
Figure 4D:
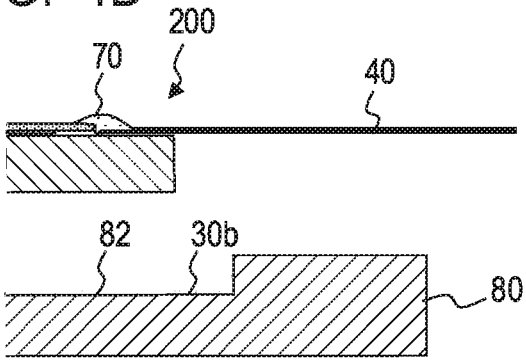

Next, the first support member 30 is bonded to the third support surface 80*b* of the second support member 80 with a third adhesive 82 (step S6). FIG. 4C illustrates a schematic perspective view of the second support member 80 to which the chip unit 200 and the third adhesive 82 are applied, and FIG. 4D illustrates a schematic cross-sectional view taken along the line F-F in FIG. 4C. The third adhesive 82 is applied around the opening 83 of the third support surface 80*b* of the second support member 80, and the chip unit 200 is float-bonded. The third adhesive 82 is a thermosetting resin. The second support member 80 has a long shape in the X direction, and a plurality of chip units 200 is arranged in an in-line form in the longitudinal direction (X direction) of the second support member 80 and bonded to the second support member 80. Butting bonding may be used instead of the floating bonding.

Figure 4E:
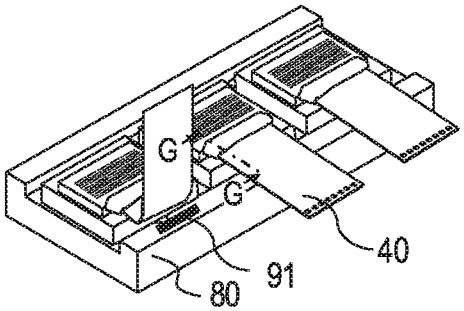
Figure 4F:
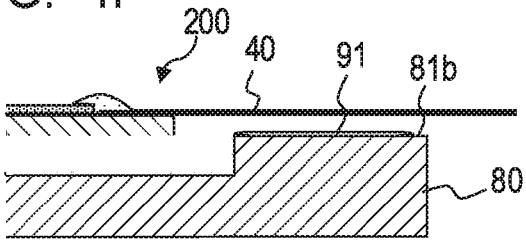

Next, a second adhesive 91 is applied to the second support surface 80*a* of the second support member 80 (Step S7). FIG. 4E illustrates a schematic perspective view of the second support member 80 to which the chip unit 200 and the second adhesive 91 are applied, and FIG. 4F illustrates a schematic cross-sectional view taken along the line G-G in FIG. 4E. The application of the second adhesive 91 can be performed, for example, by transfer. The second adhesive 91 is a thermosetting resin. The second adhesive 91 may be applied to the back surface of the electric wiring substrate 40, and the adhesive sheet may be used as the second adhesive 91. Upon applying the second adhesive 91, the electric wiring substrate 40 may be bent upward and fixed with a jig (not illustrated).

Figure 4G:
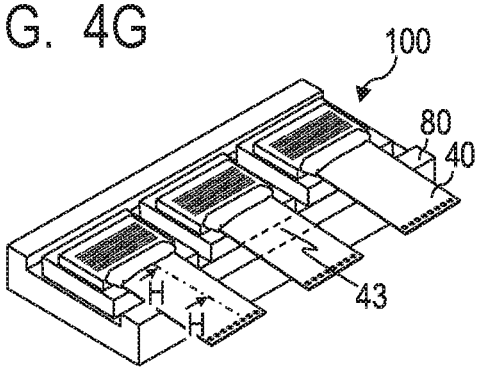
Figure 4H:
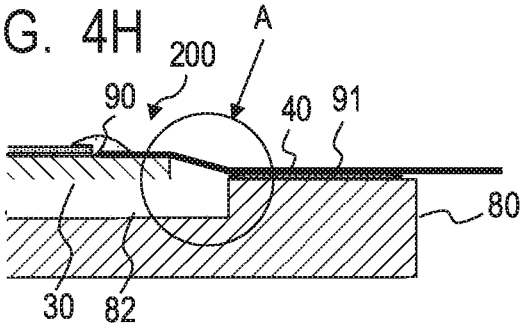

Next, the electric wiring substrate 40 is bonded to the second support surface 80*a* of the second support member 80 (step S8). FIG. 4G illustrates a schematic perspective view of the chip unit 200 to which the electric wiring substrate 40 is bonded and the second support member 80, and FIG. 4H illustrates a schematic cross-sectional view taken along the line H-H in FIG. 4G. The intermediate portion 43 of the electric wiring substrate 40 overlaps on the second adhesive 91, and the intermediate portion 43 of the electric wiring substrate 40 is pressed by a pressing tool 120. The pressing tool 120 can generate heat, and the electric wiring substrate 40 is pressed by the pressing tool 120 that generates heat. As a result, the second adhesive 91, which is a thermosetting resin, is cured, and the intermediate portion 43 of the electric wiring substrate 40 is bonded to the second support surface 80*a* of the second support member 80 by the second adhesive 91. That is, the intermediate portion 43 of the electric wiring substrate 40 is bonded to the second support surface 80*a* by pressing the electric wiring substrate 40 with the pressing tool 120 (see FIGS. 5A to 8) while heating the thermosetting resin. In one example, the electric wiring substrate 40 is pressed by the pressing tool 120 for 20 seconds heated to 130° C., and thermally compressed. The electric wiring substrate 40 extends between the first support surface 30*a* and the second support surface 80*a* so as to straddle the groove 20. This step is performed to increase the alignment accuracy between the second connection terminal 42 of the electric wiring substrate 40 and the device that generates the electric signal.

If the electric wiring substrate 40 is bonded to the second support surface 80*a* in a state in which the electric wiring substrate 40 is tensioned, the wiring of the electric wiring substrate 40 is likely to be damaged with a change in environmental temperature. For example, when the linear expansion coefficient of the second support member 80 is greater than that of the electric wiring substrate 40, the electric wiring substrate 40 may be stretched by the extension of the second support member 80, and the electric wiring substrate 40 is likely to be broken due to a tensile stress. Therefore, the method for bonding the electric wiring substrate 40 and the second support member 80 for suppressing the wirings of the electric wiring substrate 40 from being damaged will be described with reference to some embodiments.

First Embodiment

Figure 5A:
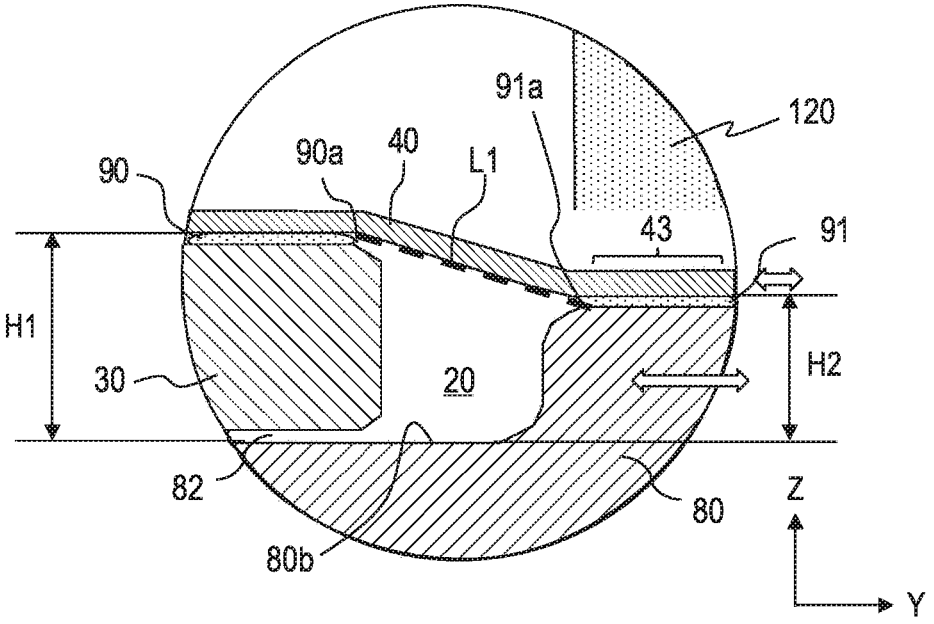
FIG. 5A and FIG. 5B are diagrams illustrating a method for bonding an electric wiring substrate according to a first embodiment.
Figure 5B:
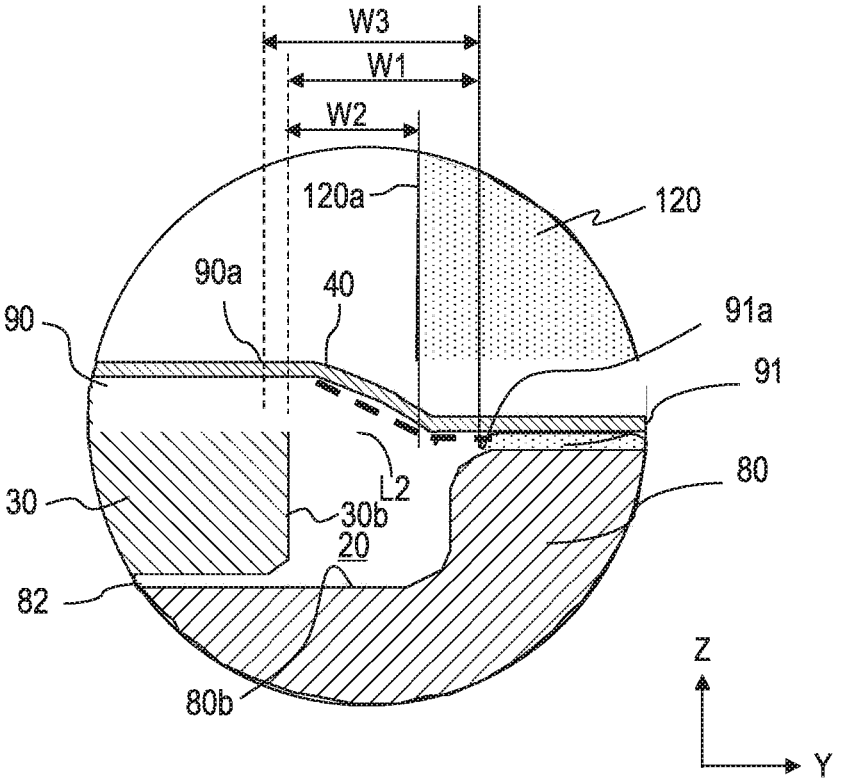

FIGS. 5A and 5B are detailed views illustrating portion A of FIG. 4H, FIG. 5A illustrates Comparative Example, and FIG. 5B illustrates a first embodiment. In the Comparative Example and the first embodiment, a total thickness H1 of a first support member 30, a first adhesive 90, and a third adhesive 82 is 1.3 mm, and a height H2 from a third support surface 80*b* to an upper surface of a second adhesive 91 is 0.9 mm. The first support surface 30*a* is further away from a bottom surface 20*a* of a groove 20 or the third support surface 80*b* in a direction (Z direction) orthogonal thereto than a second support surface 80*a*, and a relationship of H1>H2 is established. A linear expansion coefficient of an electric wiring substrate 40 is 16 ppm, and a linear expansion coefficient of a second support member 80 is 30 ppm. In the following description, opposing end portions of the first adhesive 90 and the second adhesive 91, that is, the end portion of the first adhesive 90 facing the second adhesive 91 and the end portion of the second adhesive 91 facing the first adhesive 90 are referred to as a first end portion 90*a* and a second end portion 91*a*, respectively. The first end portion

90*a* and the second end portion 91*a* are collectively referred to as both end portions. In addition, some dimensions are defined as follows:

L1: Linear distance or a shortest distance between the first end portion 90*a* of the first adhesive 90 and the second end portion 91*a* of the second adhesive 91 (see FIG. 5A)

L2: Distance along the electric wiring substrate 40 between the first end portion 90*a* of the first adhesive 90 and the second end portion 91*a* of the second adhesive 91 (see FIG. 5B)

W1: Y-direction distance (interval) between a side surface 30*b* (side surface of a recording element unit 14) facing the groove 20 of the first support member 30 and the second end portion 91*a* of the second adhesive 91

W2: Y-direction distance (interval) between a side surface 30*b* facing the groove 20 of the first support member 30 and a side surface 120*a* of a pressing tool 120 facing the side surface 30*b* when an intermediate portion 43 of the electric wiring substrate 40 is bonded to the second support surface 80*a*

W3: Y-direction distance (interval) between the first end portion 90*a* of the first adhesive 90 and the second end portion 91*a* of the second adhesive 91

In the following description, the end portion of the pressing tool 120 means the end portion on the first support member 30 side of two lower end portions of the pressing tool 120 facing the electric wiring substrate 40.

In the Comparative Example, the end portion of the pressing tool 120 is positioned at the same position as the second end portion 91*a* in the Y direction or at a position further away from the first support member 30 than the second end portion 91*a*, and the electric wiring substrate 40 is thermally compressed. Since the pressing tool 120 does not exist between both end portions of the first adhesive 90 and the second adhesive 91, the electric wiring substrate 40 is linearly bonded between both end portions, and a shortest distance L1 and a distance L2 become L1=L2. Even after the pressing tool 120 is away from the electric wiring substrate 40, the electric wiring substrate 40 is tensioned between both end portions and does not relax. Since a linear expansion coefficient of the second support member 80 is greater than that of the electric wiring substrate 40, if the environmental temperature increases, the second support member 80 moves relatively to the right in the Y direction with respect to the electric wiring substrate 40 as illustrated by an arrow in FIG. 5A. For this reason, the intermediate portion 43 fixed by the second adhesive 91 of the electric wiring substrate 40 is stretched to the right by the second support member 80, and the portion positioned above the groove 20 of the electric wiring substrate 40 is subjected to a tensile stress. A stress concentration is likely to occur in a bent portion near both end portions of the electric wiring substrate 40.

On the other hand, in the first embodiment, as illustrated in FIG. 5B, the end portion of the pressing tool 120 is positioned between both end portions of the first adhesive 90 and the second adhesive 91 in the Y direction, and the pressing tool 120 is lowered to thermally compress the electric wiring substrate 40. Accordingly, when the electric wiring substrate 40 is pressed by the pressing tool 120, the electric wiring substrate 40 is deformed so as to be bent downward between both end portions, such that L2>L1 is satisfied. When the electric wiring substrate 40 is bonded (fixed) to the second support surface 80*a* by the second adhesive 91 and then the pressing tool 120 is raised to release the pressure, the electric wiring substrate 40 relaxes (becomes in a state in which the electric wiring substrate 40 is not tensioned). The step of bending the electric wiring substrate 40 between both end portions in this way is called forming. By carrying out forming and bonding for the electric wiring substrate 40, the possibility of disconnection and the like due to the difference in the linear expansion coefficients between the second support member 80 and the electric wiring substrate 40 is reduced. L2 preferably satisfies the relationship of L2>L1, and more preferably satisfies the relationship of $1.003 \times L1 \leq L2 \leq L1 \times 1.2$. This relationship is obtained by adjusting the Y-direction position of the pressing tool 120. Specifically, $W2 \leq 0.8 \times W1$ is preferable. However, since it is necessary to avoid the contact between the pressing tool 120 and the first support member 30, it is preferable that $0 < W2 \leq 0.8 \times W1$ be satisfied more accurately. The portion of the electric wiring substrate 40 between the first adhesive 90 and the second adhesive 91 is pushed downward toward the groove 20 by the pressing tool 120. For this reason, the possibility that the electric wiring substrate 40 protrudes above the sealing material 70 due to forming and comes into contact with the recording medium and therefore is damaged is reduced.

In this embodiment, the electric wiring substrate 40 is bonded using the heated pressing tool 120, but the second support member 80 is heated in advance, and the electric wiring substrate 40 is pressed by the pressing tool 120 in the state in which the temperature of the second support member 80 and the second adhesive 91 rises. In order to bond the electric wiring substrate 40 in the state in which the second support member 80 is thermally expanded, when the second support member 80 is cooled, the second adhesive 91 formed on the second support member 80 moves toward the first support member 30. As a result, forming for the electric wiring substrate 40 can be naturally carried out.

Second Embodiment

Figure 6A:
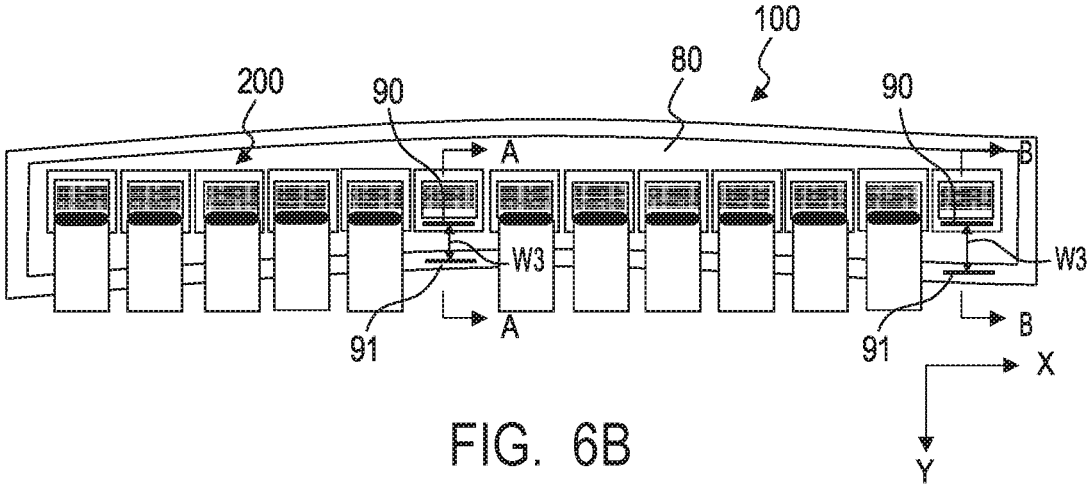
FIG. 6A, FIG. 6B and FIG. 6C are diagrams illustrating a method for bonding an electric wiring substrate according to a second embodiment.

A second embodiment of the present invention will be described with reference to FIGS. 6A to 6C. In the following description, differences from the first embodiment will be mainly described. Points that are not described are the same as in the first embodiment. FIG. 6A illustrates a plan view of a liquid ejection head 100 to which a plurality of chip units 200 is attached. As described above, since a second support member 80 has a long shape in an X direction, in particular, the second support member 80 has a length of 1 m or more in the X direction, when a resin member is employed for cost reduction, the second support member 80 tends to warp in a Y direction. Even in this case, since the chip unit 200 is linearly arranged along the X direction on the second support member 80, a relative position of the chip unit 200 with respect to the second support member 80 in the Y direction or a dimension of the groove 20 in the Y direction is likely to change for each chip unit 200. In other words, the plurality of first support members 30 to which the electric wiring substrate 40 is bonded is linearly bonded to the second support member 80 so that a Y-direction width of the groove 20 is different between at least two first support members 30.

Figure 6B:
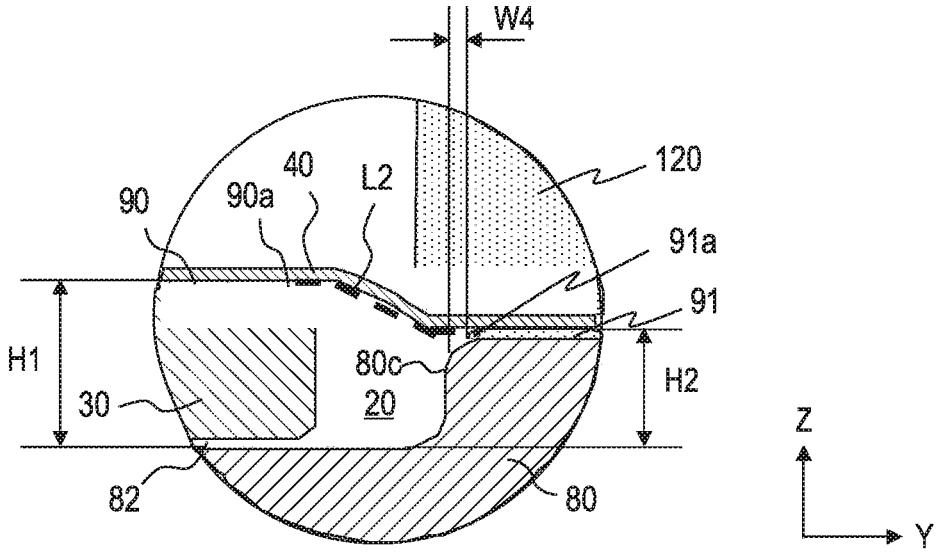
Figure 6C:
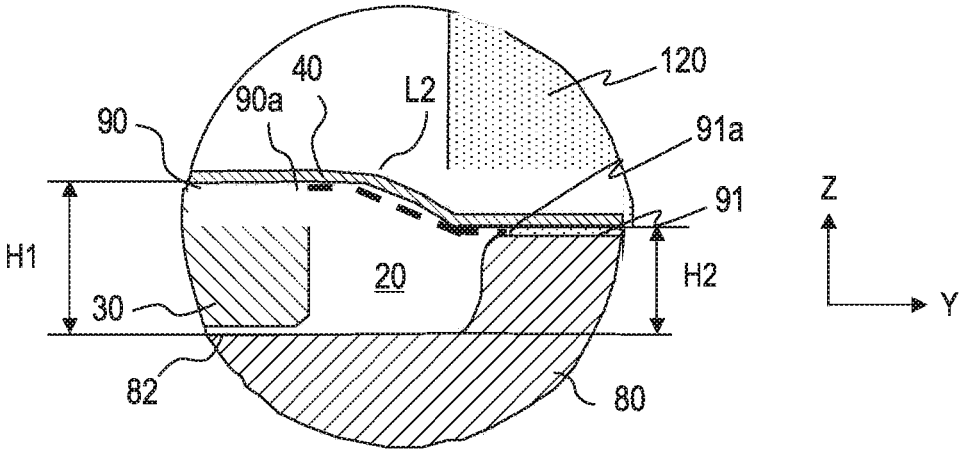

FIGS. 6B and 6C illustrate cross-sectional views taken along the lines A-A and B-B in FIG. 6A, respectively. As illustrated in these drawings, the second adhesive 91 is applied so that a Y-direction distance between a side surface 80*c* facing the groove 20 of the second support member 80 and a second end portion 91*a* of the second adhesive 91 is the same in each chip unit 200. In this case, W1 and W3 are small at the center of the second support member 80 in the X direction, and are large at the end portion of the second support member 80 in the X direction. Therefore, if a Y-direction position of the pressing tool 120 is determined so that an absolute value of W2 is the same in all chip units 200, W2/W1 changes for each chip unit 200. As a result, there is the possibility that the chip unit 200 that does not satisfy $1.003 \times L1 \leq L2 \leq L1 \times 1.2$ is formed. In the present embodiment, the Y-direction position of the pressing tool 120 is set so as to satisfy $1.003 \times L1 \leq L2 \leq L1 \times 1.2$ for each first support member 30 (each other support member). L1 and L2 are obtained from H1-H2 and W1 to W3, and W1 to W3 can be corrected according to the amount of warpage. Therefore, if H1-H2 is the same for each chip unit 200, the amount of warpage of the second support member 80 in the Y direction may be measured in advance at the attachment position of each chip unit 200 before the chip unit 200 is attached to the second support member 80. Then, the Y-direction position of the pressing tool 120 can be determined so as to satisfy $1.003 \times L1 \leq L2 \leq L1 \times 1.2$ depending on the amount of warpage.

Third Embodiment

A third embodiment of the present invention will be described with reference to FIG. 7A and FIG. 7B. In the following description, differences from the first embodiment will be mainly described. Points that are not described are the same as in the first embodiment. As described above, the plurality of first support members 30 is float-bonded to the second support member 80. However, the thickness of the third adhesive 82 may change for each chip unit 200. That is, the plurality of first support members 30 is at least two first support members 30, and the first support member 30 is likely to be linearly bonded to the second support member 80 so that the height difference H1-H2 of the surfaces of the first adhesive 90 and the second adhesive 91 is different.

Figure 7A:
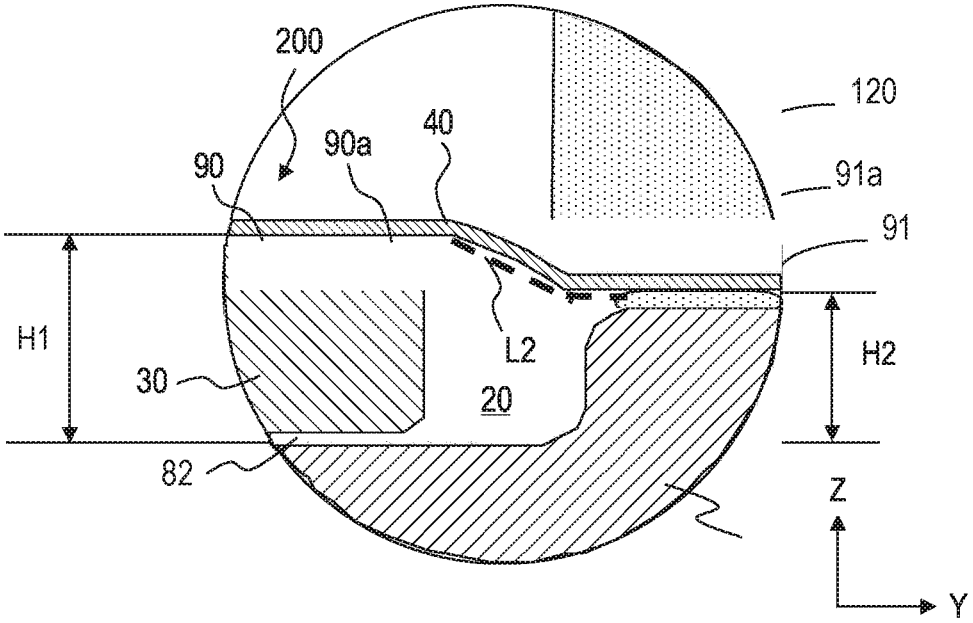
FIG. 7A and FIG. 7B are diagrams illustrating a method for bonding an electric wiring substrate according to a third embodiment.
Figure 7B:
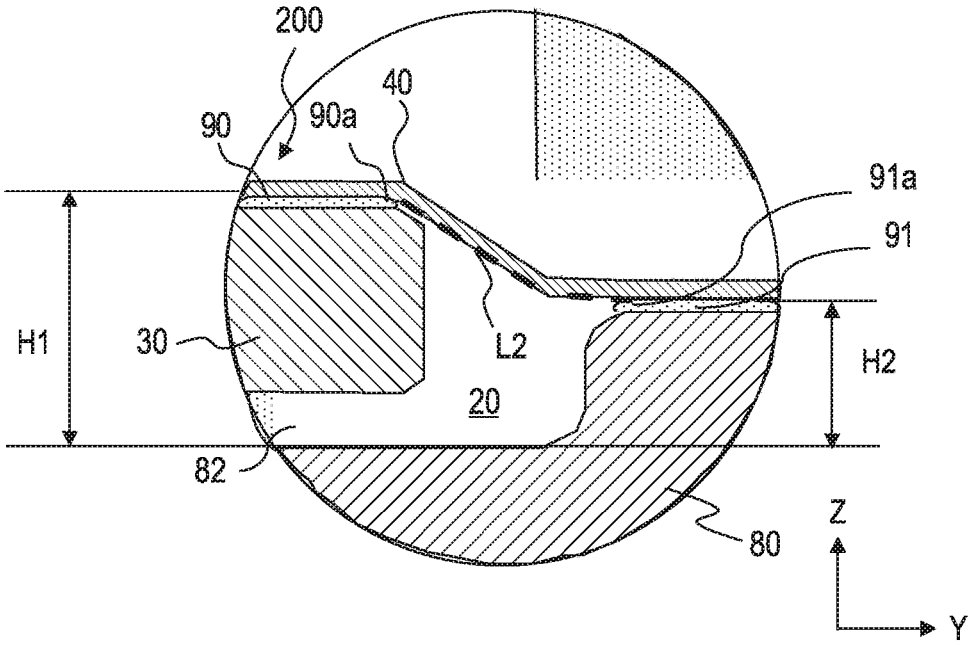

FIG. 7A illustrates the chip unit 200 in which the thickness of the third adhesive 82 is thin, and FIG. 7B illustrates the chip unit 200 in which the thickness of the third adhesive 82 is thick. Since H1 is different depending on the chip unit 200, if the Y-direction position of the pressing tool 120 is determined so that the absolute value of W2 is the same in all the chip units 200, the chip unit 200 that does not satisfy $1.003 \times L1 \leq L2 \leq L1 \times 1.2$ is likely to be formed. In the present embodiment, the Y-direction position of the pressing tool 120 is set so as to satisfy $1.003 \times L1 \leq L2 \leq L1 \times 1.2$ for each first support member 30. As described above, since L1 and L2 are obtained from H1, H2, and W1 to W3, if H2 and W1 to W3 are the same in each chip unit 200, H1 may be corrected for each chip unit 200. Specifically, the thickness of the third adhesive 82 is measured at the position of each first support member 30, H1 is corrected depending on the thickness of the third adhesive 82, and the Y-direction position of the pressing tool 120 can be determined to satisfy $1.003 \times L1 \leq L2 \leq L1 \times 1.2$.

Note that this embodiment can also be combined with the second embodiment. Even if H1-H2 and W1 to W3 are different for each chip unit 200, by obtaining these dimensions in advance, the Y-direction position of the pressing tool 120 is set to satisfy $1.003 \times L1 \leq L2 \leq L1 \times 1.2$ for each first support member 30.

Fourth Embodiment

Figure 8:
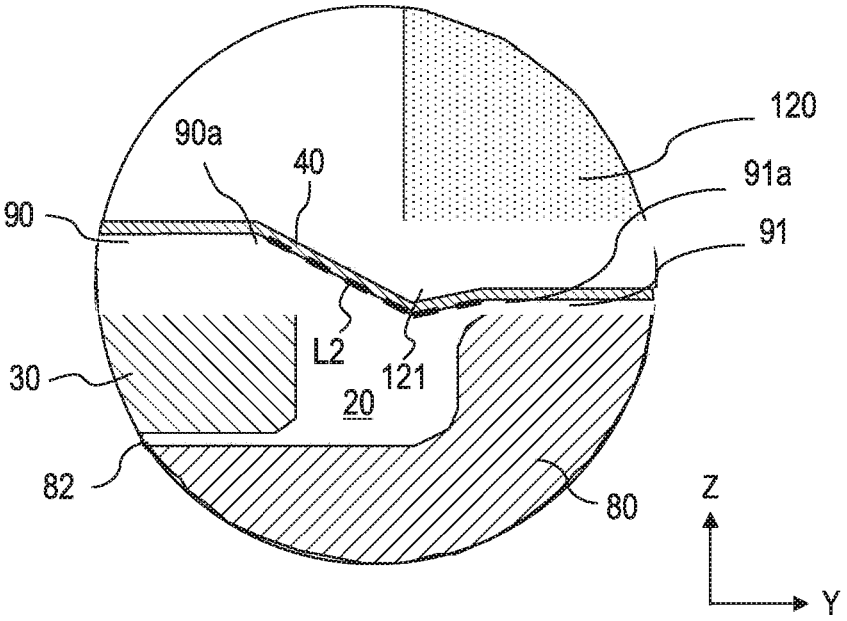
FIG. 8 is a diagram illustrating a method for bonding an electric wiring substrate according to a fourth embodiment.

A fourth embodiment of the present invention will be described with reference to FIG. 8. In the following description, differences from the first embodiment will be mainly described. Points that are not described are the same as in the first embodiment. A pressing tool 120 has a protrusion 121 protruding toward a bottom surface 20*a* of a groove 20 at an end portion that presses an electric wiring substrate 40. When the pressing tool 120 is lowered, the protrusion 121 comes into contact with the electric wiring substrate 40, so forming for the electric wiring substrate 40 is carried out while the pressing tool 120 is lowered. Since the pressing tool 120 presses the electric wiring substrate 40 early, an adjustment time of a Y-direction position of the pressing tool 120 can be shortened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-236284, filed Dec. 18, 2018, which is hereby incorporated by reference herein in its entirety.

What is claimed is:

1. A method for manufacturing a liquid ejection head including an element substrate that includes an ejection orifice configured to eject liquid and an energy-generating element configured to generate energy for ejecting the liquid from the ejection orifice, and an electric wiring substrate that supplies an electric signal for driving the energy-generating element to the element substrate, the method for manufacturing a liquid ejection head comprising:

overlapping a second portion of the electric wiring substrate and a second support surface through an adhesive so that the electric wiring substrate straddles a groove between a first support surface to which a first portion, which is one end of the electric wiring substrate, is bonded and the second support surface; and pressing the second portion and a third portion by a pressing tool to bond the second portion and the second support surface so that the third portion of the electric wiring substrate, which is a portion between the first portion and the second portion, is pushed into the groove.

2. The method for manufacturing a liquid ejection head according to claim 1, wherein the adhesive is a thermosetting resin, and the electric wiring substrate is pressed by the pressing tool while the thermosetting resin is heated to bond the second portion and the second support surface.

3. The method for manufacturing a liquid ejection head according to claim 2, wherein the pressing tool can generate heat, and the electric wiring substrate is pressed by the pressing tool generating heat.

4. The method for manufacturing a liquid ejection head according to claim 2, wherein the electric wiring substrate is pressed by the pressing tool in a state in which a temperature of the second support surface rises.

5. The method for manufacturing a liquid ejection head according to claim 1, wherein the pressing tool is positioned so that an end portion of a pressing surface of the pressing tool in a width direction of the groove overlaps the groove, and the second portion and the third portion are pressed by the pressing tool.

6. The method for manufacturing a liquid ejection head according to claim 5, wherein, when an interval between an end portion of the first support surface closer to the groove and an end portion of the adhesive closer to the groove is W1, and an interval between the end portion of the first support surface and the end portion of the pressing tool upon bonding the second portion of the electric wiring substrate and the second support surface is W2, W2≤0.8×W1 is satisfied.

7. The method for manufacturing a liquid ejection head according to claim 1, wherein the pressing tool has a protrusion protruding toward a bottom surface of the groove on an end portion that presses the electric wiring substrate.

8. The method for manufacturing a liquid ejection head according to claim 1, wherein a portion between the first portion and the second portion relaxes after the electric wiring substrate is bonded by the adhesive.

9. The method for manufacturing a liquid ejection head according to claim 1, wherein the first support surface is further away from a bottom surface of the groove than the second support surface is from the bottom surface of the groove.

10. The method for manufacturing a liquid ejection head according to claim 1, wherein the liquid ejection head includes:

a plurality of units, each of which includes the element substrate, the electric wiring substrate, and a first support member that has the first support surface and supports the element substrate; and a second support member that has the second support surface and supports the plurality of units.

11. The method for manufacturing a liquid ejection head according to claim 10, wherein the plurality of units is linearly arranged on the second support member along a longitudinal direction of the second support member.

12. The method for manufacturing a liquid ejection head according to claim 10, wherein a width of the groove is different between a first unit and a second unit of the plurality of units, and when the electric wiring substrate is pressed by the pressing tool, a position of an end portion of the pressing surface of the pressing tool in a width direction of the groove is different between the first unit and the second unit.

13. A liquid ejection head comprising:

a plurality of units, each of which includes an element substrate including an ejection orifice configured to eject liquid and an energy-generating element configured to generate energy for ejecting the liquid from the ejection orifice, an electric wiring substrate that supplies an electric signal for driving the energy-generating element to the element substrate, and a first support member that supports the element substrate; and a second support member that supports the plurality of units, wherein the first support member has a first support surface to which a first portion, which is one end of the electric wiring substrate, is bonded, the second support member has a second support surface to which a second portion of the electric wiring substrate is bonded by an adhesive and which is along the first support surface, and has a groove provided between the first support surface and the second support surface, and the electric wiring substrate extends between the first support surface and the second support surface so as to straddle the groove, and a portion of the electric wiring portion between the first portion and the second portion is relaxed.

14. The liquid ejection head according to claim 13, wherein the first support surface is further away from a bottom surface of the groove than the second support surface is from the bottom surface of the groove.

15. The liquid ejection head according to claim 13, wherein the first support member is formed of ceramics, and the second support member is formed of a resin.

16. The liquid ejection head according to claim 13, wherein the plurality of units is linearly arranged on the second support member along a longitudinal direction of the second support member.

17. The liquid ejection head according to claim 13, wherein the first portion is bonded to the first support surface by the adhesive, and a shortest distance L1 between an end portion of an adhesive bonding the first portion and an end portion of an adhesive bonding the second portion, the end portion of the adhesive bonding the first portion and the end portion of the adhesive bonding the second portion opposing each other, is less than a distance L2 between the opposing end portions in a direction along the electric wiring substrate.

* * * * *